US011981500B2

(12) United States Patent
Cetta

(10) Patent No.: US 11,981,500 B2
(45) Date of Patent: May 14, 2024

(54) DISPENSER FOR GRIP-ENHANCING SUBSTANCE

(71) Applicant: Michael Cetta, Cutler Bay, FL (US)

(72) Inventor: Michael Cetta, Cutler Bay, FL (US)

( * ) Notice: Subject to any disclaimer, the term of this patent is extended or adjusted under 35 U.S.C. 154(b) by 0 days.

(21) Appl. No.: 17/733,915

(22) Filed: Apr. 29, 2022

(65) Prior Publication Data

US 2022/0348397 A1 Nov. 3, 2022

Related U.S. Application Data

(60) Provisional application No. 63/181,477, filed on Apr. 29, 2021.

(51) Int. Cl.

| | |
|---|---|
| ***B65D 83/06*** | (2006.01) |
| ***A45F 5/02*** | (2006.01) |
| ***B65D 47/28*** | (2006.01) |

(52) U.S. Cl.

CPC ..... *B65D 83/06* (2013.01); *A45F 5/021* (2013.01); *B65D 47/286* (2013.01); *B65D 2547/06* (2013.01)

(58) Field of Classification Search

CPC .. B65D 83/06; B65D 47/286; B65D 2547/06; A45F 5/021

See application file for complete search history.

(56) References Cited

U.S. PATENT DOCUMENTS

| | | | | |
|---|---|---|---|---|
| 5,419,071 | A * | 5/1995 | Fatica | F42B 33/0292 86/33 |
| 5,597,102 | A * | 1/1997 | Saarikko | H04B 1/3833 224/904 |
| 5,944,264 | A * | 8/1999 | Truax | A01C 7/02 239/152 |
| 6,089,477 | A * | 7/2000 | Dillon | A01C 15/02 239/653 |
| 6,729,558 | B1 * | 5/2004 | Seenauth | B05B 7/1427 239/152 |
| 7,032,787 | B2 * | 4/2006 | Sherk, Jr. | G01F 11/18 222/441 |
| 2002/0190078 | A1 * | 12/2002 | Adolphi | A23G 9/28 222/105 |
| 2004/0031808 | A1 * | 2/2004 | Aldred | A23G 9/28 221/197 |
| 2012/0218106 | A1 * | 8/2012 | Zaima | B05B 12/02 340/540 |
| 2015/0060497 | A1 * | 3/2015 | Redler | A23B 4/325 222/424.5 |
| 2022/0348397 | A1 * | 11/2022 | Cetta | B65D 83/06 |

FOREIGN PATENT DOCUMENTS

| | | | | |
|---|---|---|---|---|
| AU | 2020102149 | * | 10/2020 | |
| CA | 2525238 | A1 * | 5/2006 | B26B 19/06 |

* cited by examiner

*Primary Examiner* — Bob Zadeh
(74) *Attorney, Agent, or Firm* — Ted Whitlock; 500Law

(57) ABSTRACT

Described is a method and device for dispensing a grip-enhancing substance. In the device, a specific position of a closure provides a metered amount of the grip-enhancing substance. The device is used in a method to dispense the grip-enhancing substance to a user upon actuation of the closure by the user.

17 Claims, 14 Drawing Sheets

DISPENSER FOR GRIP-ENHANCING SUBSTANCE

FIELD OF THE INVENTION

The present invention relates to a device and method for using the device to dispense a grip-enhancing substance. More specifically, the present invention relates to a dispenser for dispensing a metered amount of a grip-enhancing substance to a user upon being triggered by said user.

BACKGROUND

Various sports leagues have taken measures to appeal to younger demographics by streamlining their games through the elimination of dead time, reduction of overtime, and increase in scoring. Baseball in particular has had difficulties streamlining because of its long, 9 inning games. The MLB has been trying to speed up the game for the last few years by, for example, not allowing players to step out of the hitter's box.

One way in which the MLB can streamline the game further is by modernizing the way players apply rosin. Issues relating to the antiquated, time consuming, and unsanitary use of rosin bags was brought to the public's attention during the COVID-19 pandemic. Players who often wipe sweat off with their hands, expectorate on their palms before gripping a bat, or even lick their fingers before tossing a ball were all sharing the same, communal rosin bag. Rather than permanently addressing the problem, the MLB's solution was to temporarily require players to bring their own individual rosin bag.

Rosin is a grip-enhancing agent well known in the art and commonly used by baseball players to improve their grip on the baseball. During a baseball game, players can apply rosin by either using the rosin bag placed behind the pitcher's mound or the rosin bag placed on the "on deck" circle for hitters. To apply rosin, players must first pick up a rosin bag and then manipulate it so that sufficient rosin powder coats their hands.

Pitchers need to walk off the pitcher's mound multiple times an inning to coat their hands in rosin. On average, it takes about 30 seconds to step off the mound, walk to a rosin bag, apply rosin, and walk back onto the mound. While 30 seconds may seem like a short amount of time, it could account for over 10 minutes of dead time in aggregate considering that a pitcher may apply rosin over 30 times in one outing. Besides being time consuming, this method of applying rosin also effects the concentration of pitcher since it often means an interruption of focus and tempo.

Outfielders are similarly affected since they depend on rosin to increase their grip on the baseball. Besides the sweat on their hands affecting their grip, outfielders are often faced with baseballs that have accumulated moisture from rolling through humid grass. Unlike pitchers who have the benefit of a rosin bag that is near and easily accessible, outfielders must travel to the pitcher's mound and then return to their positions just to apply rosin on their hands.

Hitters are similarly affected by a lack of rosin accessibility since the only time a hitter can apply rosin is on the on-deck circle, before stepping onto the field or the hitter's box. Unlike the pitcher and fielders who may reapply rosin, a hitter is unable to return to the on-deck circle for rosin. This often means that a hitter must make do with one application of rosin for multiple pitch at bat.

What is needed is a device for dispensing a grip-enhancing substance that can increase the substance's accessibility and decrease the time it takes to apply.

SUMMARY OF THE INVENTION

The present invention is directed to a wearable device for dispensing a grip-enhancing substance and a method for using said device with the grip-enhancing substance to apply the grip-enhancing substance to a user.

The wearable device according to the subject invention comprises a housing bounding a chamber configured to contain a bulk amount of a grip-enhancing substance. The housing further includes at least one port formed in the housing. The at least one port allows passage of the grip-enhancing substance into and out of the housing. The device further includes a closure which obstructs the port when in a closed position preventing the grip enhancing substance from being dispensed. The closure un-obstructs the port when in an opened position, allowing the grip-enhancing substance to be dispensed through the un-obstructed port. The wearable dispenser can be fastened to the clothes of a user through an attachment. The attachment can be a flange or a clip fastener.

As will be further appreciated from the description herein, the dispenser can further include an actuator for actuating the closure in an opened position and a closed position. The actuator can be spring loaded and biased in a closed position. The actuator is in communication with the closure and actuates the closure into an opened or closed position.

The chamber can have disposed therein a receptacle for receiving grip enhancing substance. Preferably, the receptacle can be shaped or formed as a hopper. The hopper can contain a bulk amount of grip-enhancing substance which can be in a liquid form or a in solid form such as a powder. The powder can be rosin powder, chalk, calcium carbonate, synthetic rosin, or a combination thereof.

The closure can alternatively be a rotatable receptacle delimiting a cavity in which a metered amount of the grip-enhancing substance can be contained. The grip-enhancing substance is dispensed through the port upon the receptacle's rotation. Alternatively, the closure can prevent passage of grip enhancing substance through the port by obstructing the port when in the closed position and slidably un-obstructing the port when in the open position to allow grip enhancing substance to pass through.

The port can be operable for passage of the grip enhancing substance into and out of the chamber. Alternatively, the grip enhancing substance can be transferred into the chamber through an input port.

The method for using the device to dispense provides for a wearable dispenser for dispensing a metered amount of grip-enhancing substance and a bulk amount of the grip-enhancing substance to be contained within the chamber of the dispenser. The dispenser comprises a housing, at least one port formed in the housing, and a closure. The housing bounds a chamber configured to contain a bulk amount of a grip-enhancing substance which is dispensed in a metered amount through the at least one port. A closure obstructs the at least one port when in a closed position and un-obstructs the at least one port when in an opened position, allowing the grip-enhancing substance to be dispensed through the at least one unobstructed port.

The method comprises the step of actuating the closure to an opened position to dispense a metered amount of the grip-enhancing substance to a user. The method can comprise the additional step of refilling the chamber with the grip-enhancing substance.

BRIEF DESCRIPTION OF THE DRAWINGS

The drawings as provided herein set forth exemplary embodiments of the present invention, the detailed description of which follows hereinbelow. The drawings are merely exemplary and are not intended to limit the invention as encompassed by the claims appended herewith.

DETAILED DESCRIPTION

The present invention is directed to a dispenser for dispensing a metered amount of grip-enhancing substance and method of use thereof. The dispenser and method of the present invention is advantageously convenient, readily accessible, and fast to operate. The subject dispenser and its components can be readily understood by reference to the drawings attached hereto.

Figure 1A:
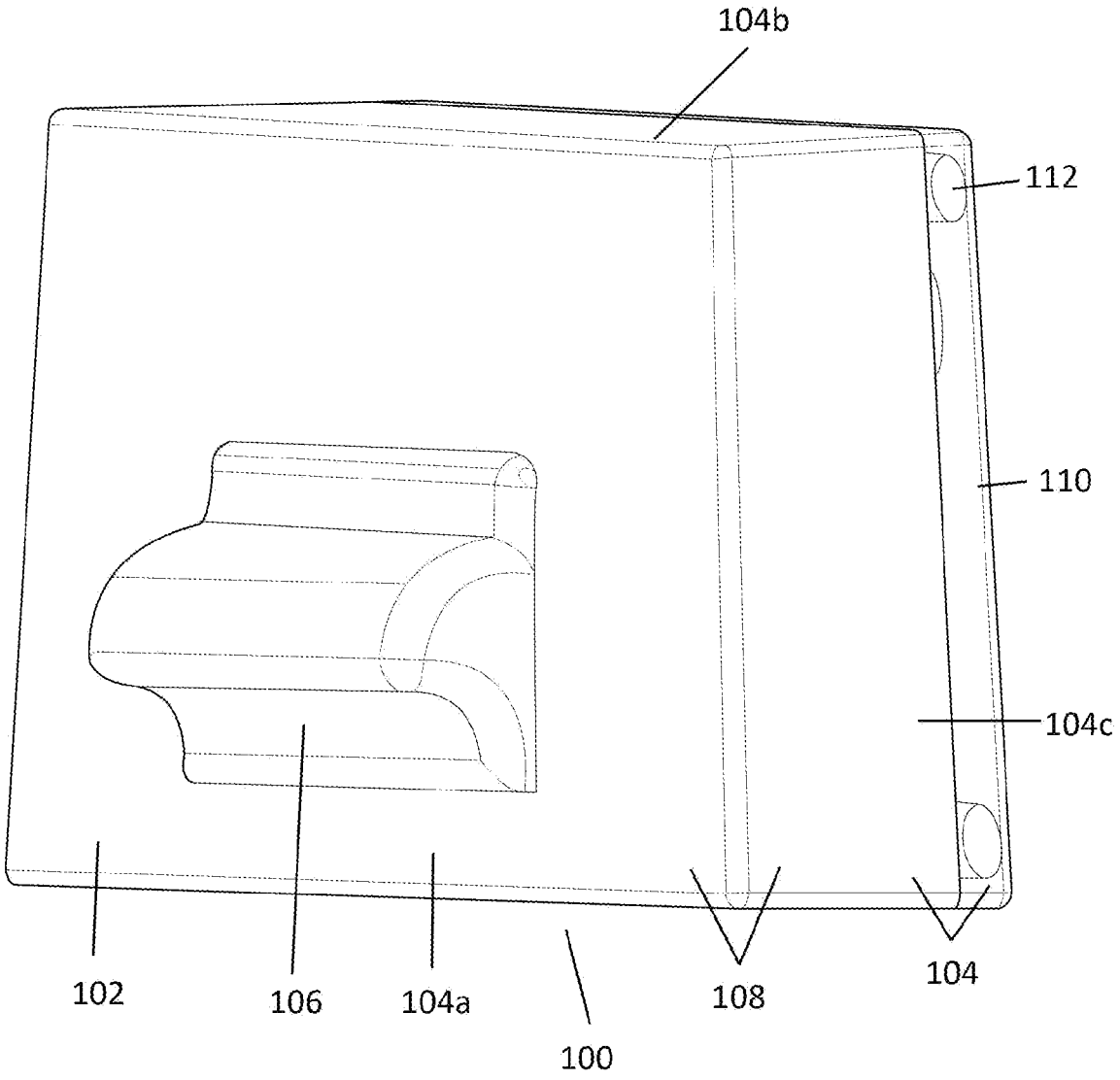
FIG. 1A is a front perspective view of a dispenser for dispensing a metered amount of grip-enhancing substance in accordance with an embodiment of the present invention.

FIG. 1A shows one embodiment present invention. In the embodiment, the dispenser 100 is illustrated comprising a housing 102 including an outer housing surface 104 having a front housing face 104*a*, rear housing face 104*d* (shown in FIG. 2), top housing face 104*b*, bottom housing face 104*e* (shown in FIG. 3), and a first housing side face 104*c* and second housing side face (not shown). The housing 102 bounds a chamber 200 (shown in detail in FIG. 2) configured to contain a bulk amount of grip-enhancing substance for dispensing.

The housing 102 shown in this embodiment is cubical in form but it can be appreciated by those skilled in the art that the housing 102 shape is not critical, as long as the housing 102 bounds a chamber 200. For example, in the embodiment of the dispenser 100 of FIG. 5A, the housing 102 is be rounded. Similar ergonomic shapes are envisioned for other embodiments of the dispenser 100 and can include shapes that are circular, hemispherical, cylindrical, and the like.

Figure 2:
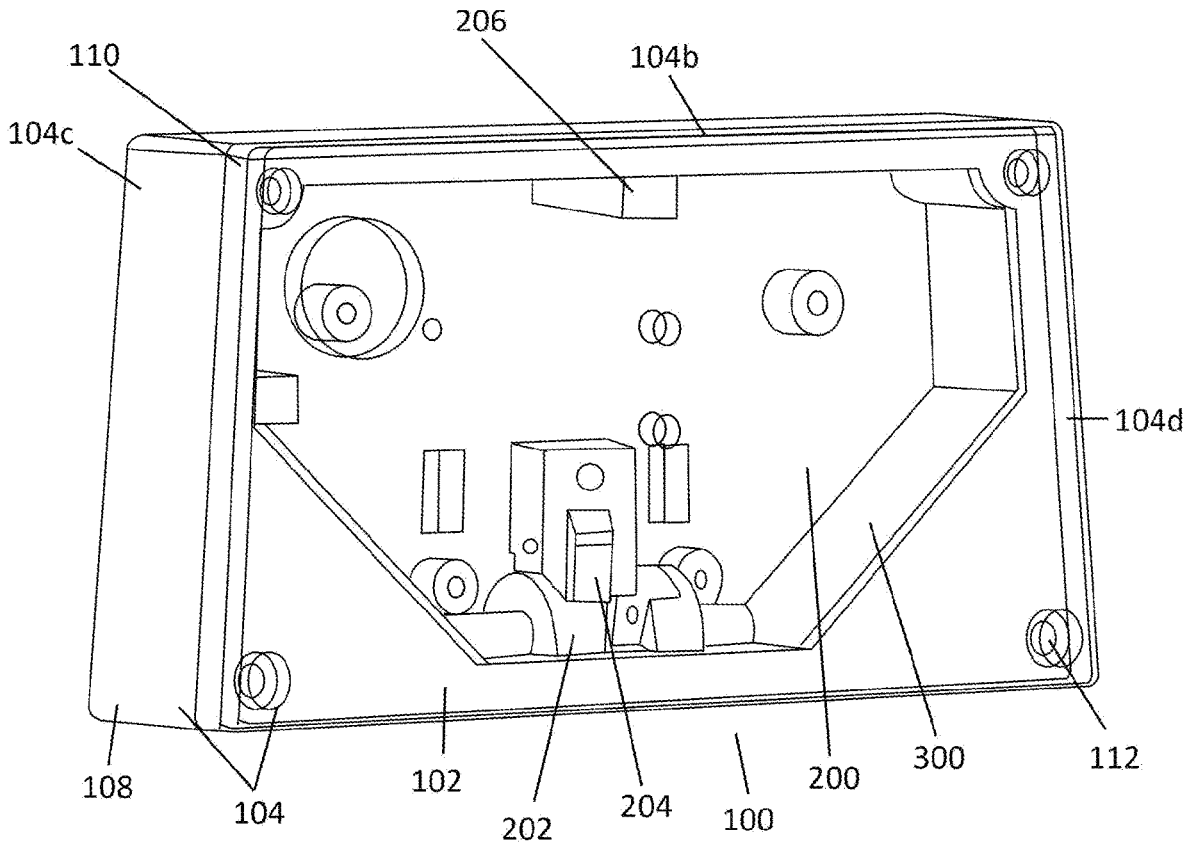
FIG. 2 rear perspective view of the dispenser of FIG. 1A.

The housing 102 further comprises a rear housing portion 110 detachably affixed to a front housing portion 108 through at least one fastener 112 and at least one tab 206 (shown in FIG. 2). The rear housing portion 110 can be detached to transfer the grip-enhancing substance into or out of the chamber 200. It would be understood in the art that the detachably affixed rear housing portion 110 can be affixed using screws or other fasteners well known in the art such as rivets, bolts, and the like. The rear housing portion 110 can advantageously be transparent so that a user can observe the quantity of grip-enhancing substance contained within the chamber 200.

In an alternate embodiment, the housing 102 can comprise a hingedly affixed portion in either the front housing face 104*a*, rear housing face 104*d*, top housing face 104*b*, bottom housing face 104*e*, first housing side face 104*c*, or second housing side face. The hingedly affixed portion can be opened to allow transfer of grip-enhancing substance into or out of the chamber 200.

In one embodiment of the present invention, the grip-enhancing substance can be introduced into the chamber 200 through an input port on the housing 102. The input port can be covered by a plug, tab, stopper, lid, or other known covers when in a closed position and uncovered to allow transfer of the grip-enhancing substance into the chamber 200 when in an opened position. In another embodiment, a port 500 (shown in FIG. 3) formed in the housing 102 can be used to both dispense the grip-enhancing substance out of the chamber and introduce the grip-enhancing substance into the chamber.

FIG. 1A further illustrates a lever 106 portion of an actuator. The lever 106 is shown disposed outside of the front housing face 104*a* of the outer housing surface 104. The lever 106 portion of the actuator is configured to be operable by a user. It would be understood that the lever's 106 placement is not critical to the invention as long as it is accessible to the user.

The lever 106 is therefore not limited to being disposed outside of the front housing face 104*a* and can be disposed outside of any one of the other surfaces including the rear housing face 104*d*, top housing face 104*b*, bottom housing face 104*e*, first housing side face 104*c*, or second housing side face. For example, the embodiment shown in FIG. 5A, the lever 106 is disposed outside of the first housing side face 104*c* and operable by the user to trigger the dispenser 100 to dispense a metered amount of grip-enhancing substance.

Similarly, the lever 106 is not limited to the configuration shown in FIG. 1A and in some embodiments can take the form of a knob, trigger, button, crank, handle, and the like. For example, in one embodiment, the lever 106 is a knob that is operated by being rotated by a user. In a preferred embodiment, the lever 106 is a handle that operable by a user applying a downward force to trigger the dispenser 100 to dispense a metered amount of grip-enhancing substance. In a more preferred embodiment, the lever 106 is a button that can be pressed by the user to trigger the dispenser 100 to dispense a metered amount of grip-enhancing substance.

In an alternate embodiment of the dispenser 100, the closure 202 can be manually operated by the user into an opened or closed position without requiring an actuator or lever 106. A gripping surface or tab can be shaped on the surface of the closure 202 to allow for user manipulation. The closure 202 can be spring loaded and biased in a closed position. A metered amount of grip-enhancing substance can be dispensed upon manipulated of the closure 202 into an opened position. The closure can then spring back into the closed position without further user manipulation.

The metered amount of grip-enhancing substance dispensed by the dispenser would have previously been determined to be a single use amount. It would be understood that the single use amount will vary depending on the sport or activity for which the dispenser is configured. Generally, a metered amount for single use will be an amount sufficient to coat a user's palms. A single use, metered amount of grip-enhancing substance is dispensed every time a user operates the handle.

Figure 1B:
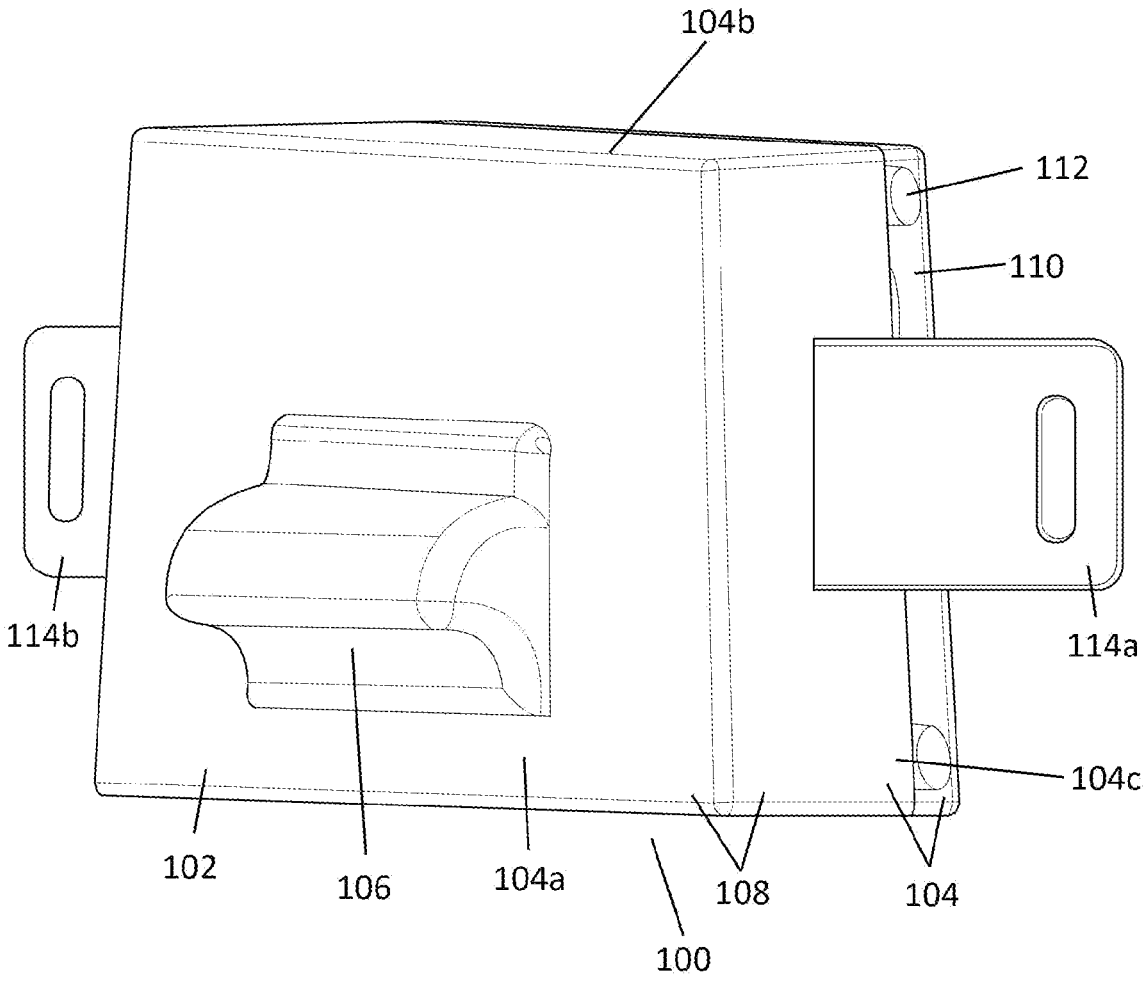
FIG. 1B is a front perspective view of a wearable embodiment of the dispenser of FIG. 1A.

It would be understood that the dispenser 100 of the present invention can be free-standing, wall-mounted, or wearable. The wearable embodiment of the dispenser can include a wearable attachment to affix the dispenser to the clothing of a user. For example, FIG. 1B shows an embodiment wherein the attachment is a flange 114*a* and 114*b* formed integral to the first housing side face 104*c* and second housing side face. The flange 114*a* and 114*b* allows the dispenser 100 to be fastened to a user's belt and worn at the hip.

In yet another embodiment, the housing 102 can be configured to include at least one tab allowing for the dispenser 100 to be attached to the user's clothing. The tab in some embodiments can be, for example, placed on the rear housing face 104*d* of the outer housing face 104. The housing can be further configured to include a harness by which the dispenser 100 can be attached to the user's body. Other forms of wearing the dispenser 100 are considered and can include hook and loop fasteners, clamps, clasps, straps, snaps, or buckles and the like.

A wall-mounted version is also considered in which the housing 102 can include a mounting support structure by which the dispenser 100 can be attached to a wall through fastening means well known in the art such as screws, rivets, bolts, and the like. Additional embodiments can include other means of mounting the dispenser to a wall including adhesive, suction cups, and the like.

Figure 1C:
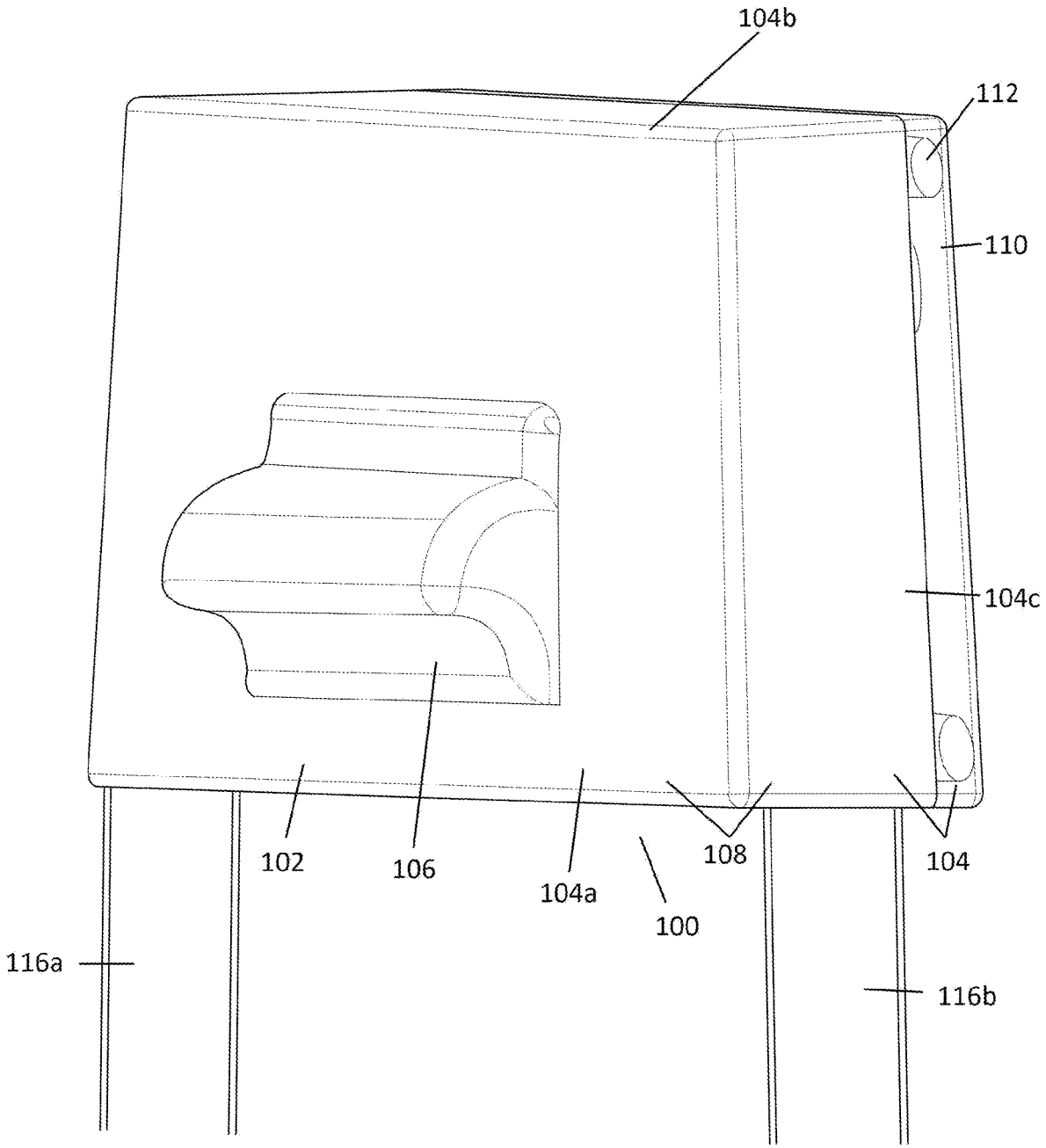
FIG. 1C is a front perspective view of a free-standing embodiment of the dispenser of FIG. 1A.

Alternatively, the dispenser 100 can be configured to be in a free-standing form. The housing 102 can include a stand (116*a* and 116*b*), base, support structure, and the like allowing it to stand freely. It would be understood that the stand (116*a* and 116*b*) is not critical to the invention and can include varying configurations which can allow it to be adjusted to varying heights or configurations. Similarly, it would be understood that stand (116*a* and 116*b*), base, support structure, and the like does not have to be formed integral to the housing and can be configured to be detachable. For example, FIG. 1C includes a stand (116*a* and 116*b*) formed integral to the housing on which the dispenser 100 rests in an upright position.

FIG. 2 is rear perspective view of the dispenser 100 showing a chamber 200 bounded by the housing 102, wherein the chamber 200 is configured to contain a grip-enhancing substance which is dispensed through a port 500 (shown in FIG. 3) formed in the housing. Disposed within the chamber 200 is a closure 202 and a tumbler 204 which are communicatively coupled to the lever 106. The actuator comprises the lever 106 and a connector that can include a tumbler 204 and a joint 400 (shown in detail in FIG. 3). The lever 106 can be manually operated by a user to actuate the closure 202 from a closed configuration to an opened configuration and from an opened configuration to a closed configuration. Transfer of the grip-enhancing substance from the chamber 200 and through the port 500 is prevented by the closure 202 which, when in a closed configuration, covers the port 500. In one preferred embodiment, the closure 202 is biased in the closed configuration, alternating to an opened configuration upon being actuated by the actuator.

In one embodiment of the invention, the chamber 200 can be configured to hold a grip-enhancing substance that is in a liquid form such as pine tar. In another embodiment, the chamber 200 is configured to hold a grip-enhancing substance that is in a solid form. In a preferred embodiment, the chamber 200 is configured to hold a grip-enhancing substance that is in a solid, powdered form such as calcium carbonate powder, rosin powder, and the like. In an alternative embodiment, the grip-enhancing substance can be contained within a package which is introduced into the chamber 200 where the grip-enhancing substance can be discharged through perforation of the package.

The chamber 200 further comprises angled chamber walls 300 which advantageously facilitate dispensing of the grip-enhancing substance by directing it towards the port 500. The angled chamber walls 300 and the remaining chamber surface contacting the grip-enhancing substance can be composed of a non-stick material to prevent the grip-enhancing substance from sticking to the chamber walls and to facilitate dispensing the grip-enhancing substance. Non-stick materials such as polytetrafluoroethylene, silicone, and the like are known in the art and are effective for such purposes.

Figure 3:
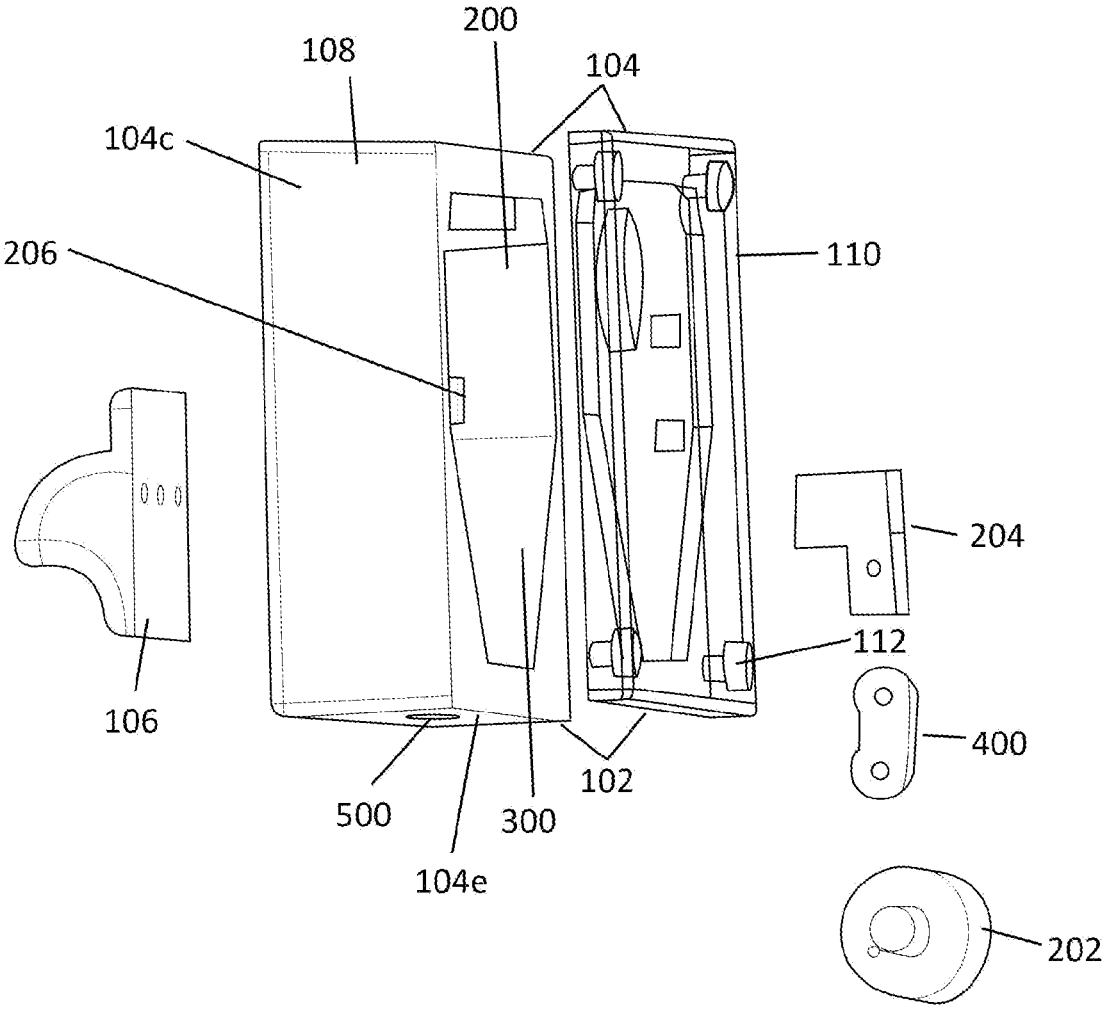
FIG. 3 is an exploded, side perspective view of the dispenser of FIG. 1A.

The exploded view of the dispenser 100 shown in FIG. 3 shows the different components of the actuator. The actuator comprises a handle 106 as well as a connector including a tumbler 204 and a joint 400 for connecting the tumbler 204 to the closure 202. The joint 400 can be a pivot joint, rotating joint, linear joint, revolving joint or any other joint known in the art. In an alternate embodiment, the joint 400 directly connects the handle 106 to the closure 202 without requiring a tumbler 204.

The closure 202 is actuated through the application of force on the handle 106 by a user which in turn triggers the tumbler 204 and joint 400, engaging the closure 202 to alternate between a closed position and an opened position.

Figure 4:
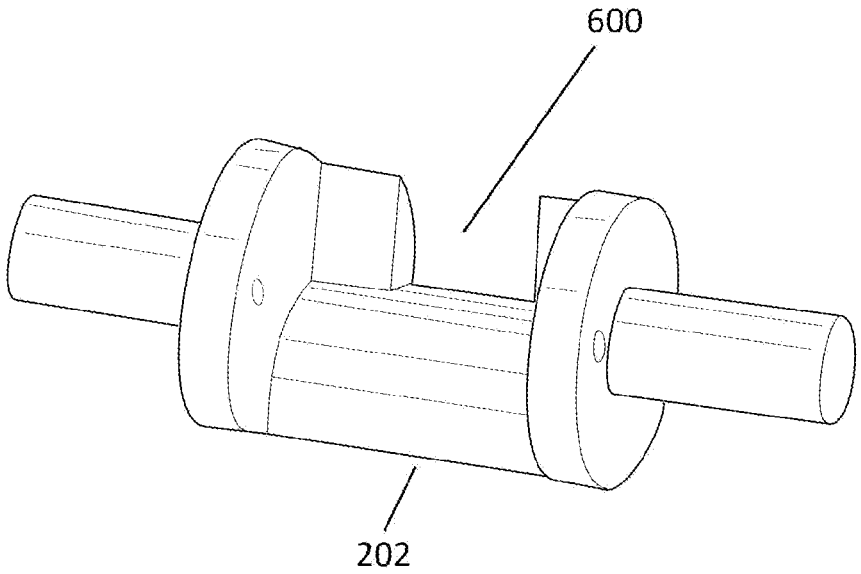
FIG. 4 is a front perspective view of the closure of FIG. 1A.

In a preferred embodiment, the closure 202 dispenses a metered amount of the grip-enhancing substance. FIG. 4 illustrates one embodiment of the closure 202 in the form of a rotatable receptacle with a cavity 600 for holding a metered amount of the grip-enhancing substance.

The cavity 600 on the receptacle can be filled with grip-enhancing substance when in the closed position. The grip-enhancing substance can then be released when the closure 202 is triggered by the user operating the lever 106 and engaging the actuator to alternate to an opened position. In another embodiment, the closure 202 can be a door that enters the opened position momentarily, upon actuation by a user, to dispense a metered amount of the grip-enhancing substance before returning to the closed position.

In yet another embodiment of the present invention, the closure 202 can be a rotatable cylinder delimiting various cavities 600 capable of holding a metered amount of the grip-enhancing substance. The cylinder rotates upon actuation by a user, with the cavities 600 being filled with the grip-enhancing substance as they enter the chamber 200 and releasing the grip-enhancing substance as they exit the chamber 200 through the port 500.

Figure 5A:
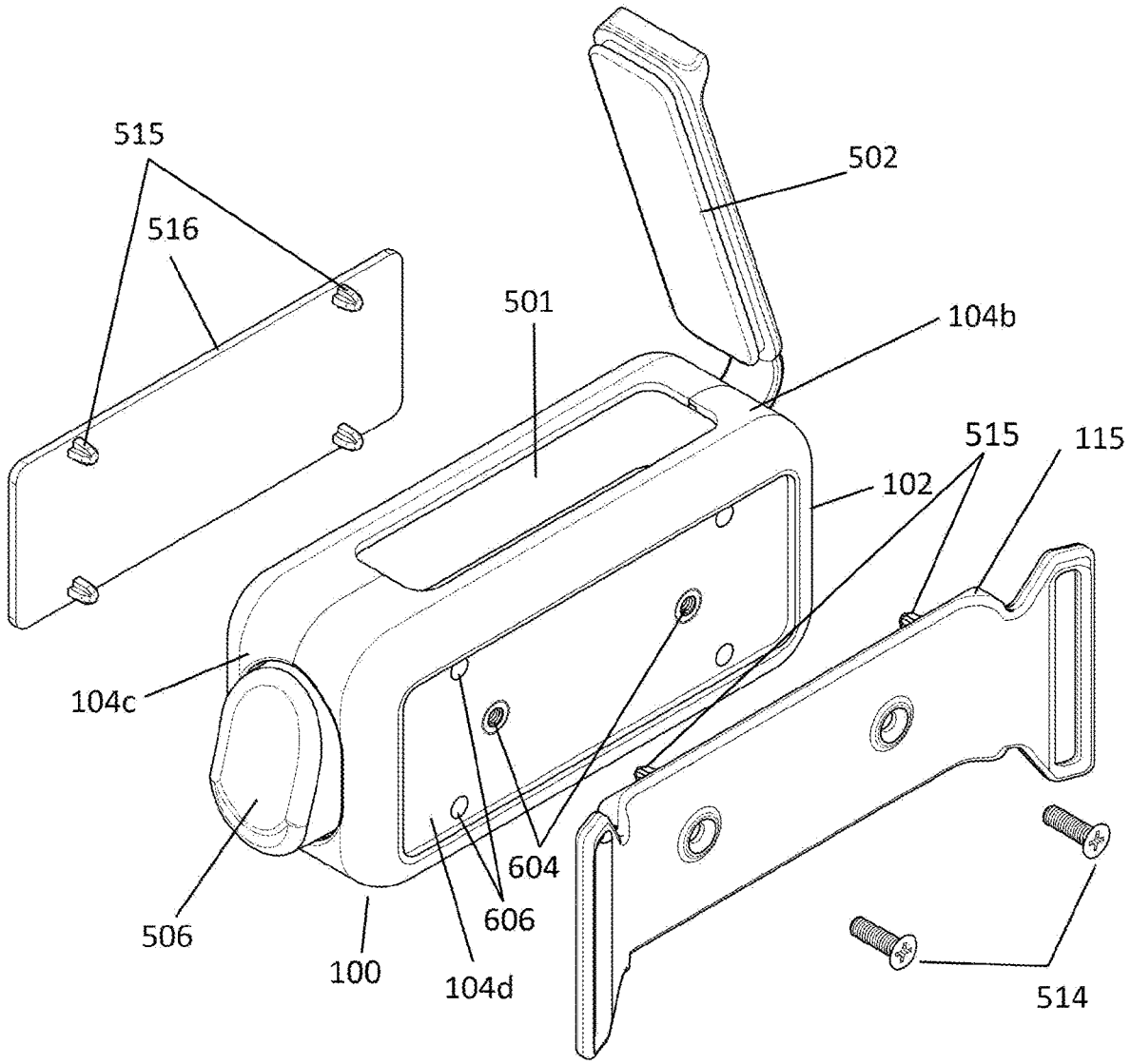
FIG. 5A is a back perspective view of one embodiment of the present invention.

FIG. 5A shows an alternate embodiment of the dispenser 100 from a top, perspective view. In it, the top housing face 104*b*, rear housing face 104*d*, first housing side face 104*c*, and the dispenser housing 102 are shown. The top housing face 104*b* has an input port 501 which is used for introducing grip enhancing substance into the dispenser 100. The input port 501 is removably covered by the lid 502 when the lid 502 is in the closed position (shown in FIG. 5B) and exposed when the lid 502 is in the opened position. It should be appreciated that whether the lid 502 is affixed to the housing 102 or is entirely removable is not critical to the invention as long as it prevents the grip enhancing substance from passing through the input port 501 when in the closed position. Advantageously, the lid 502 is shown in this embodiment is prevented from being misplaced or lost by being affixed to the housing via a strap 503 which is connected at one end to the lid 502 and at the other end to the housing 102. It would be understood that the way in which the lid 502 is affixed to the housing can vary and can include a hinge, tether, pin, and the like.

The rear housing face 104*d* is shown having at least one insert 604 and at least one recess 606. The at least one insert 604 configured to receive least one fastener 514 and the at least one recess 606 configured to receive at least one knob 515. The flanged belt loop 115 is coupled to the rear housing face 104*d* via at least one fastener 514 and at least one knob 515 located on the inner surface of the flanged belt loop 115. The flanged belt loop 115 allows the user to attach and wear the dispenser 100 on his or her clothing. In a preferred embodiment, the rear housing face 104*d* has up to two inserts 604 for receiving up to two fasteners 514. In another preferred embodiment, the rear housing face 104*d* has up to four recesses 606 for receiving up to four knobs 515.

In one embodiment, the housing 102 can receive a housing face cover 516 on the front housing face 104*a* (shown in FIG. 6) and/or the rear housing face 104*b*. As will be better appreciated from the embodiment of FIG. 5B, the housing face cover 516 can be coupled to the front housing face 104*a* of the dispenser 100. The front housing face 104*a* (shown in FIG. 6) contains at least one insert 604 configured to receive least one fastener 514 and the at least one recess configured to receive at least one knob 515. Advantageously, the flanged belt loop 115 can be affixed to either the front housing surface 104*a* for left-handed use of the dispenser, or the rear housing surface 104*d* for right-handed use of the dispenser. The housing face cover 516 covers the at least one insert 604 and the at least one recess 606 on front housing face 104*a* when the flanged belt loop 115 is affixed to the rear housing face 104*d* and covers the at least one insert 604 and the at least one recess 606 on the rear housing face 104*d* when the flanged belt loop 115 is affixed to the front housing face 104*a*. It would be understood that the housing face cover 516 is not a critical to the function of the dispenser device and can be excluded from the dispenser 100 in certain embodiments.

Figure 5B:
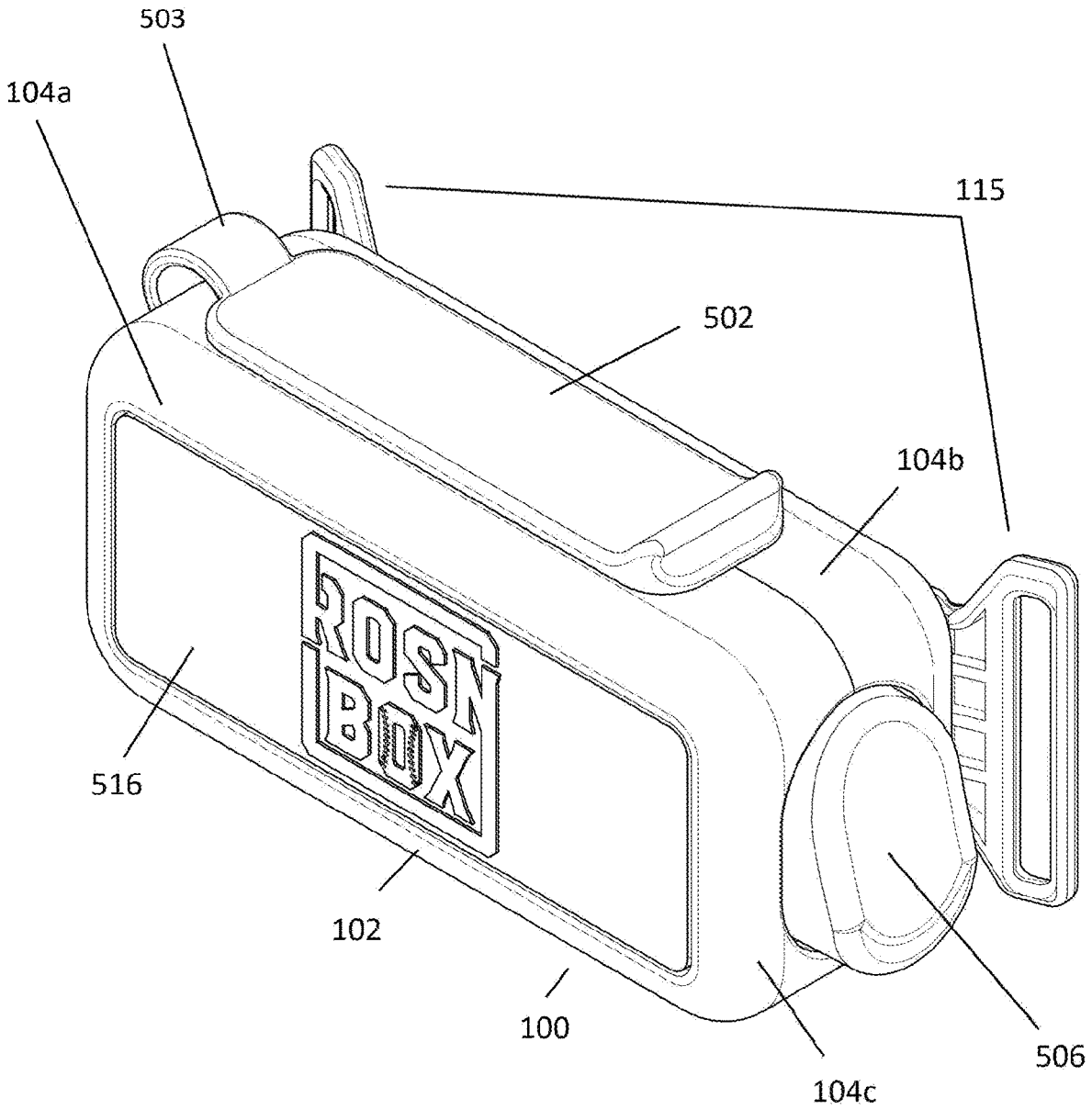
FIG. 5B is a front perspective view of the dispenser of FIG. 5A.

Also shown in FIG. 5B, is the lid 502 covering the input port 501 when in the closed position. The lid 502 is shown having a strap 503 on one end and a raised edge on the other end. It would be understood that the raised edge on the lid is not critical to the invention as long as the lid can be opened to introduce the grip enhancing substance. Advantageously, the raised edge shown in the embodiment of FIG. 5B allows for better manipulate of the lid into the opened position by the user.

Figure 5C:
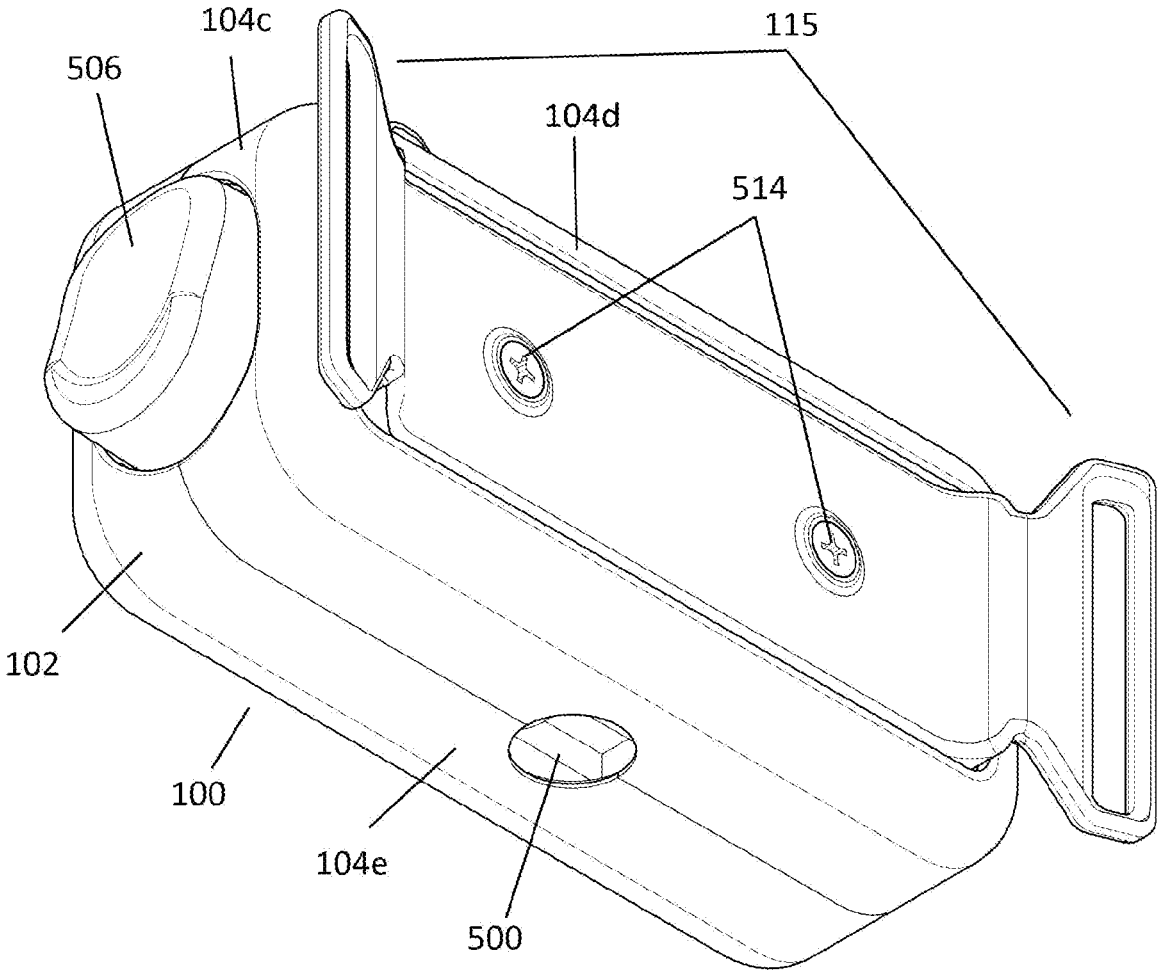
FIG. 5C is a bottom perspective view of the dispenser of FIG. 5A.

As will be appreciated on FIG. 5C, the grip enhancing substance is dispensed through the port 500 on the bottom housing face 104*e* of the dispenser. The flanged belt loop 115 is also shown fastened to the rear housing face 104*d* by the threaded fasteners 514.

Figure 6:
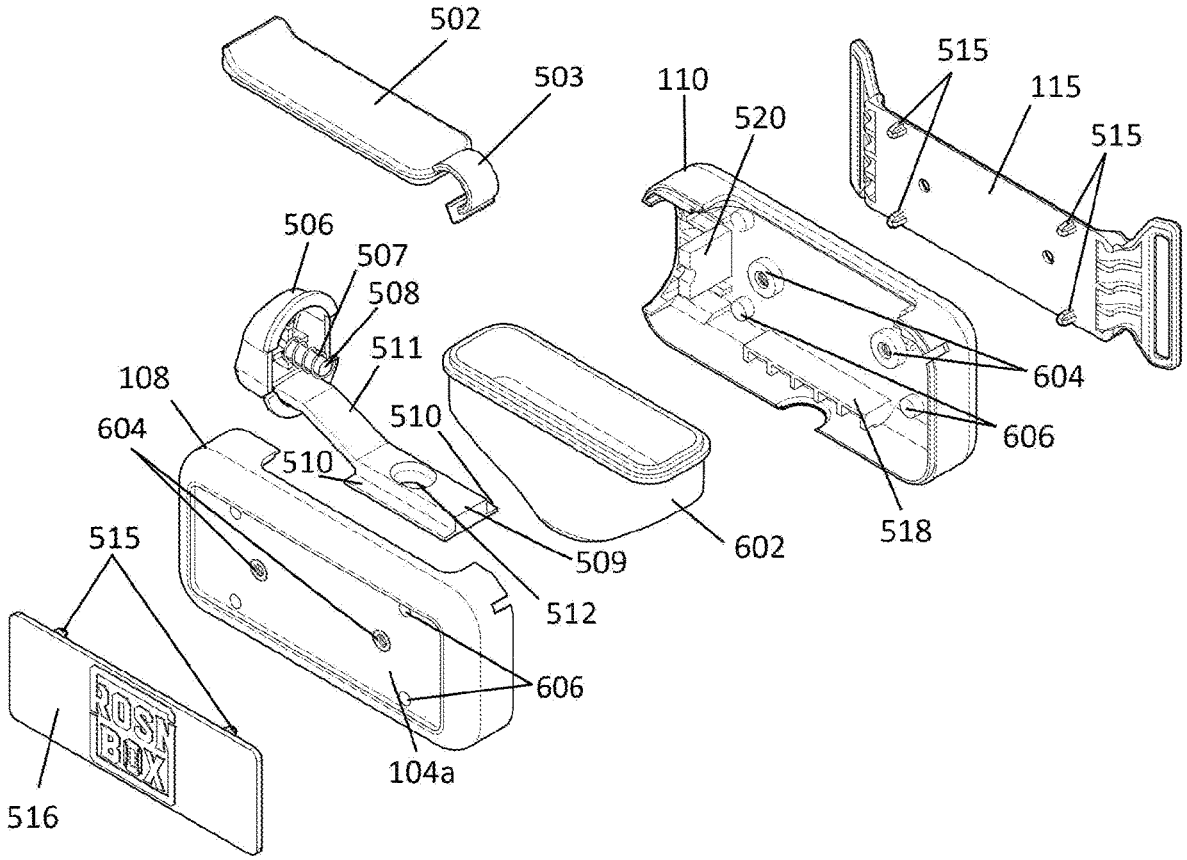
FIG. 6 is an exploded view of the dispenser of FIG. 5A.

FIG. 6 shows an exploded view of the embodiment of FIG. 5A. The housing 102 is shown separated into the front housing portion 108 and the rear housing portion 110. Located on the outer surface of the front housing portion 108 is the front housing face 104*a*. Like the rear housing face 104*d* (shown in FIG. 5A), the front housing face 104*a* is shown having at least one threaded insert 604 for receiving at least one threaded fastener 514 and at least one recess 606 for receiving at least one knob 515.

In the embodiment shown in FIG. 6, the closure is shown having a portal 512 and at least one flange 510 on at least one side of the closure 509. In a preferred embodiment, there is one flange 510 on each side of the closure 509. The inner surface of the front housing portion front housing portion 108 and the inner surface of the rear housing portion 110 have the rail 518. The rail 518 encompass the at least one flange 510 and guide the closure 509 as it slides from the closed position to the opened position and back. In one embodiment, the tab 520 can also be formed on the inner surface of the rear housing portion 108.

Positioned between the front housing portion 108 and rear housing portion 110 are the receptacle 602 and the actuator. The shape and form of the receptacle 602 is not crucial to the invention and can vary as long as it is capable of holding a bulk amount of grip enhancing substance. Advantageously, the receptacle 602 of the embodiment of FIG. 6 is in the form of a hopper, efficiently directing the grip enhancing substance downwards and out of the dispenser 100 through the receptacle exit port 601 (shown in FIG. 7A). In one embodiment, the surface of the receptacle 602 contacting the grip-enhancing substance can be composed of a non-stick material to prevent the grip-enhancing substance from sticking to the chamber walls and to facilitate dispensing the grip-enhancing substance. Non-stick materials such as polytetrafluoroethylene, silicone, and the like are known in the art and are effective for such purposes.

In one embodiment of the invention, the receptacle 602 can be configured to hold a grip-enhancing substance that is in a liquid form such as pine tar. In another embodiment, the receptacle 602 is configured to hold a grip-enhancing substance that is in a solid form. In a preferred embodiment, the receptacle is configured to hold a grip-enhancing substance that is in a solid, powdered form such as calcium carbonate powder, rosin powder, and the like. In an alternative embodiment, the grip-enhancing substance can be contained within a package which is introduced into the receptacle 602 where the grip-enhancing substance can be discharged through perforation of the package.

In one embodiment, the actuator can be comprised of the button 506 and the actuator bridge 511 for connecting the button 506 to the closure 509. On one end, the actuator bridge 511 is coupled to the inside surface of the button 506 and on the other end it is affixed to the closure 509. In a preferred embodiment, the button 506 can have an inside surface in which the bar 507 can be formed. The button 506 can be spring loaded by encompassing the bar 507 with the spring 508. When the button 506 is pressed by the user, the bar 507 passes through an opening on the tab 520. As the bar 507 passes through the opening, however, the spring 508 is compressed by the tab 520. Once the button 506 is released, the spring 508 decompresses and pushes the button 507 back to its original position.

Figure 7A:
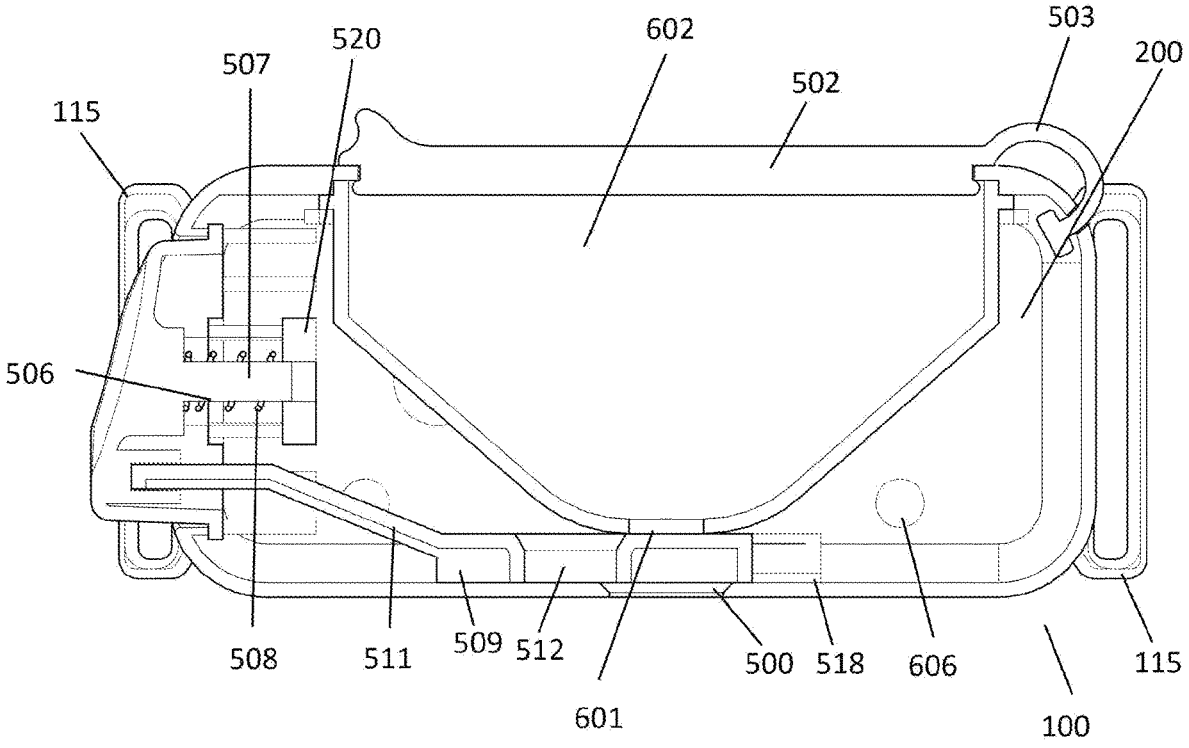
FIG. 7A is a cross-sectional view of the dispenser of FIG. 5A.
Figure 7B:
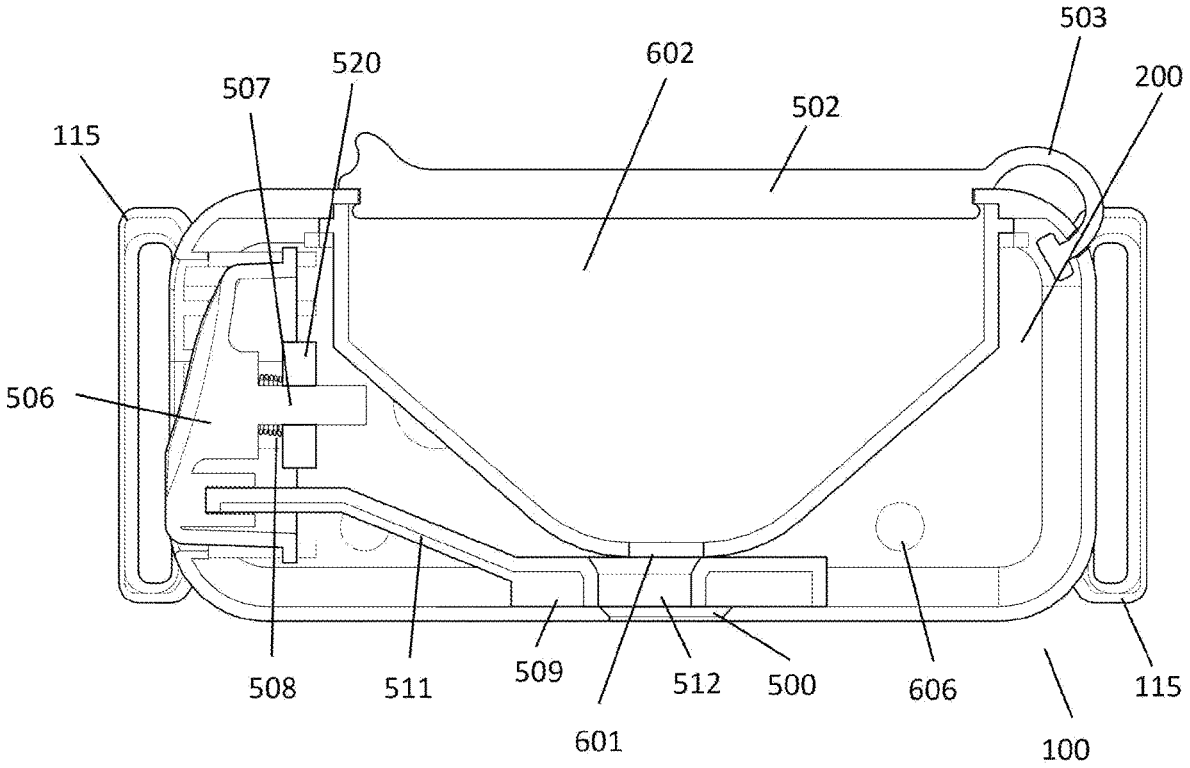
FIG. 7B is a cross-sectional view of the dispenser of FIG. 5A.

FIG. 7A shows a cross-sectional view of the dispenser 100 showing the chamber 200 which is encompassed and defined by the housing 102 as well as the receptacle 602 which is located within the chamber 200. Also shown is the closure 509 which in the closed position, abutting the receptacle exit port 601. When in the closed position, the closure 509 prevents grip enhancing substance from being dispensed by obstructing the housing port 500 and the receptacle exit port 601. FIG. 7B shows the closure 509 once it has been actuated into the opened position. In the opened position, the button 506 appears depressed into the housing 102, the bar 507 partially passes through the tab 520, and the spring 508 is compressed. The depressed button 506 moves the actuator bridge 511 further into the chamber 200 and as a result, the closure 509 slidably shifts to align the portal 512 with the receptacle exit port 601 and the housing port 500. The resulting channel allows grip enhancing substance to be dispensed to the user.

As previously discussed, the shape and form of the closure 509 is not critical to the invention as long as it dispenses a metered amount of grip enhancing substance. Similarly, the use of an actuator is not necessary to dispense a metered amount of grip enhancing substance because the closure can be directly operated into the opened position or closed position. Advantageously, the spring loaded actuator and closure 509 of the embodiment of FIGS. 5A-7B operates to allow for a metered amount of grip enhancing substance to be dispensed to the user before the spring 508 decompresses and the closure 509 returns to a closed position.

Figure 8:
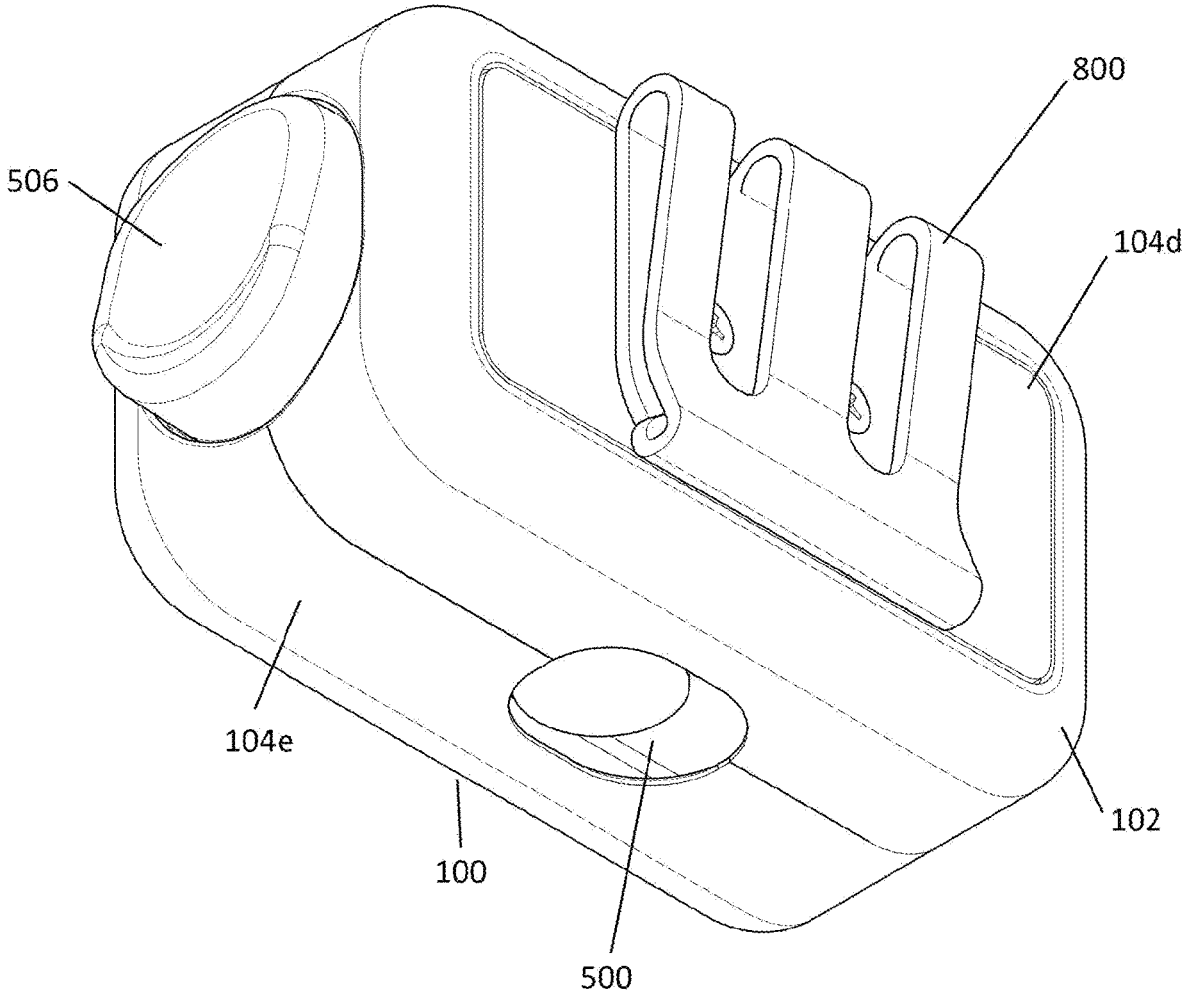
FIG. 8 is a bottom perspective view of one embodiment of the present invention.

Similarly, the shape and form of the attachment used to couple the dispenser 100 to the clothing of the user is not critical to the invention. FIG. 8 shows one embodiment of the dispenser 100 having a clip 800 affixed to the rear housing face 104*d*. Like the flanged belt loop 115 (shown in FIG. 5A), the clip 800 is not limited to the rear housing face 104*d* and can be attached to the front housing face 104*a*. Advantageously, attaching clip 800 the front housing face 104*a* allows for left-handed use of the dispenser while attaching the clip 800 to the rear housing face 104*d* allows for right-handed use of the dispenser.

In addition to a device, the present invention is also directed to a method for dispensing a metered amount of grip-enhancing substance using the structures described herein. For example, the novel method for dispensing a metered amount of grip-enhancing substance includes providing the dispenser 100 shown in FIG. 1A with a bulk amount of grip-enhancing substance.

The method comprises the step of actuating the closure to an opened position to dispense a metered amount of the grip-enhancing substance to a user. The method can comprise the additional step of refilling the chamber 200 with grip enhancing substance.

Figure 9:
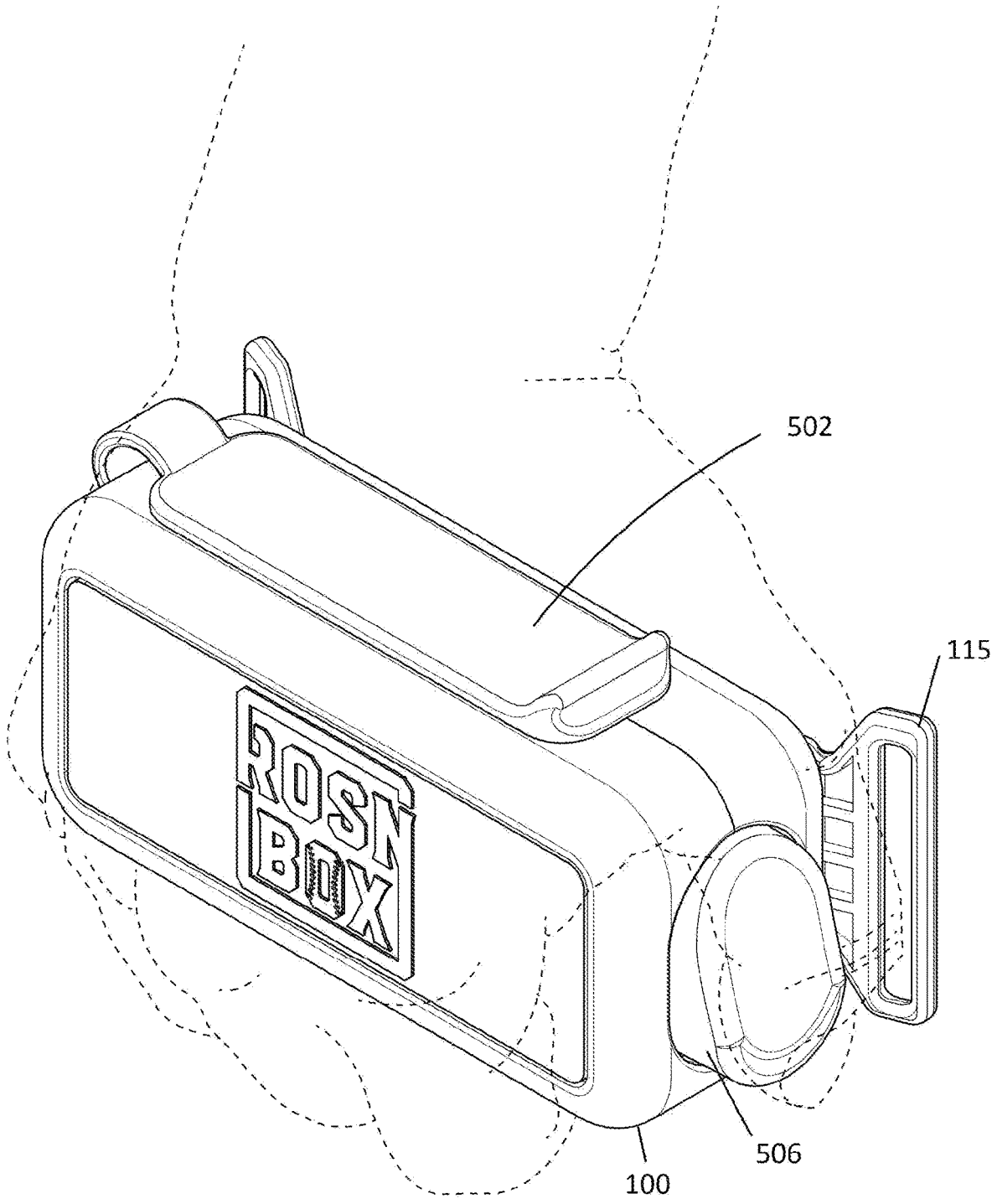
FIG. 9 is a front perspective view of the dispenser of FIG. 5A.

The present invention is also directed to a method for dispensing a metered amount of grip-enhancing substance using the structures described herein. For example, the novel method for dispensing a metered amount of grip-enhancing substance includes providing the dispenser 100 shown in FIG. 9 with a bulk amount of grip-enhancing substance.

The method comprises the step of gripping the dispenser 100 in the hand of a user and wrapping the fingers of the hand around the bottom of the dispenser 100. Actuating the closure to an opened position by pressing the button 506 to dispense a metered amount of the grip-enhancing substance to the fingers of a user. Actuating the closure back into a closed position by releasing the button 506. The method can comprise the additional step of refilling the receptacle 602 with grip enhancing substance. In addition, the method can comprise the step of affixing the dispenser 100 to the clothes through the flanged belt loop 115.

The foregoing description of the invention is illustrative only and is not intended to limit the scope of the invention to the precise terms set forth. Further, although the invention has been described in detail with reference to certain illustrative embodiments, variations and modifications exist within the scope and spirit of the invention as described and defined in the following claims.

The above disclosure and example generally describe the present invention and is provided for purposes of illustration and is not intended to limit the scope of the invention. The invention described herein may be practiced in the absence of any element or elements, limitation or limitations which is not specifically disclosed herein. Thus, for example, in each instance herein, any of the terms "comprising," "consisting essentially of," and "consisting of" may be replaced with either of the other two terms. The terms and expressions are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention as defined by the claims.

The invention claimed is:

1. A wearable device for containing and dispensing a metered amount of a grip-enhancing substance, said device comprising:

a housing having a front housing surface and back housing surface, the housing defining a chamber in which a bulk amount of the grip-enhancing substance is contained, said housing having at least one port for passage of the grip-enhancing substance within and without the chamber, wherein the chamber comprises a receptacle formed as a hopper for receiving the grip-enhancing substance and directing said grip-enhancing substance to the at least one port in the housing;

a closure capable of being actuated in an opened position to allow dispensing of the grip enhancing substance through the at least one port and a closed position to prevent dispensing of the grip enhancing substance through the at least one port, wherein the closure is selected from the group consisting of:

a) a rotatable receptacle delimiting a cavity which holds a metered amount of the grip-enhancing substance;

b) the closure slidably moveable to the opened position or the closed position; and c) the closure pivotally moveable to the opened position or closed position;

an actuator positioned on a first housing side face, said actuator being in communication with the closure so that said closure is moveable between the opened position and closed position; and an attachment for affixing the device to clothing of a user, wherein the attachment is affixable to the front housing surface or affixable to the back housing surface such that the actuator is positioned forward relative to a left-handed user when affixed to said back housing surface, and is positioned forward for a right-handed user when affixed to the front housing surface, thereby being capable of actuation by a thumb of the left-handed user and capable of being actuated by a thumb of the right-handed user to dispense grip-enhancing substance onto fingers of the user when the closure is actuated into the open position.

2. The wearable device for containing and dispensing a metered amount of a grip-enhancing substance of claim 1, wherein the at least one port is operable for dispensing the grip-enhancing substance.

3. The wearable device for containing and dispensing a metered amount of a grip-enhancing substance of claim 1, wherein the grip-enhancing substance is a solid.

4. The wearable device for containing and dispensing a metered amount of a grip-enhancing substance of claim 1, wherein the grip-enhancing substance is a powder.

5. The wearable device for containing and dispensing a metered amount of a grip-enhancing substance of claim 1, wherein the grip-enhancing substance is rosin.

6. The wearable device for containing and dispensing a metered amount of a grip-enhancing substance of claim 5, wherein the rosin is powdered rosin.

7. The wearable device for containing and dispensing a metered amount of a grip-enhancing substance of claim 1, wherein the grip-enhancing substance is a liquid.

8. The wearable device of claim 1, wherein the closure is said rotatable receptacle.

9. The wearable device for containing and dispensing a metered amount of a grip-enhancing substance of claim 2, wherein the housing includes an input port operable to introduce the grip-enhancing substance into the chamber.

10. The wearable device for containing and dispensing a metered amount of a grip-enhancing substance of claim 1, wherein the attachment is a flange.

11. The wearable device for containing and dispensing a metered amount of a grip-enhancing substance of claim 1, wherein the attachment is a clip fastener.

12. The wearable device for containing and dispensing a metered amount of a grip-enhancing substance of claim 1, wherein the actuator is spring loaded.

13. The wearable device for containing and dispensing a metered amount of a grip-enhancing substance of claim 1, wherein the closure is biased in the closed position.

14. The wearable device of claim 1, wherein the closure slidably moves to the opened position or closed position.

15. The wearable device for containing and dispensing a metered amount of a grip-enhancing substance of claim 1, wherein the closure pivotally moves to the opened position or closed position.

16. A method for dispensing a metered amount of a grip-enhancing substance, said method comprising:

providing a device of claim 1; and dispensing the metered amount of the grip-enhancing substance by actuating the closure to the opened position.

17. The method of claim 16, further comprising the step of:

refilling the hopper as needed.

* * * * *